US008210352B2

(12) United States Patent
Liao et al.

(10) Patent No.: US 8,210,352 B2
(45) Date of Patent: Jul. 3, 2012

(54) BLOCK STRENGTHENING AIR ENCLOSURE AND MANUFACTURE THEREOF

(75) Inventors: Chieh-Hua Liao, Sindian (TW); Yaw-Shin Liao, Sindian (TW); Bo-Xin Jian, Sindian (TW); Yao-Chuan Liao, Sindian (TW)

(73) Assignee: Chieh Hua Liao, Sindian (TW)

( * ) Notice: Subject to any disclaimer, the term of this patent is extended or adjusted under 35 U.S.C. 154(b) by 312 days.

(21) Appl. No.: 11/963,356

(22) Filed: Dec. 21, 2007

(65) Prior Publication Data

US 2008/0159659 A1 Jul. 3, 2008

(30) Foreign Application Priority Data

Dec. 29, 2006 (TW) ..... 95149971 A

(51) Int. Cl.
*B65D 30/10* (2006.01)

(52) U.S. Cl. ..... 206/522; 206/592; 383/3

(58) Field of Classification Search ..... 206/522, 206/521, 591, 592; 383/3, 37
See application file for complete search history.

(56) References Cited

U.S. PATENT DOCUMENTS

| | | | | |
|---|---|---|---|---|
| 4,801,213 | A | 1/1989 | Frey et al. | |
| 5,588,533 | A | 12/1996 | Farison et al. | |
| 5,819,942 | A * | 10/1998 | Sadow | 206/522 |
| 5,857,571 | A * | 1/1999 | Tschantz et al. | 206/522 |
| 7,422,108 | B2 * | 9/2008 | Yoshifusa | 206/522 |
| 2006/0032779 | A1 * | 2/2006 | Tanaka et al. | 206/522 |

FOREIGN PATENT DOCUMENTS

| | | | |
|---|---|---|---|
| DE | 202006004463 | U1 | 8/2006 |
| EP | 1479618 | A | 11/2004 |
| JP | 2003-118772 | A1 | 4/2003 |
| JP | 2004-091010 | A1 | 3/2004 |
| JP | 2006-117311 | A1 | 5/2006 |
| KR | 20-1997-0005682 | U | 6/1997 |
| WO | 00/15514 | A | 3/2000 |

* cited by examiner

*Primary Examiner* — J. Gregory Pickett
*Assistant Examiner* — Robert Poon
(74) *Attorney, Agent, or Firm* — Apex Juris, pllc; Tracy M. Heims

(57) ABSTRACT

A block strengthening air enclosure comprises a plurality of air cylinders, a plurality of nodes disposed on the plurality of air cylinders to allow the plurality of air cylinders to be bended along the plurality of nodes to form an accepting space, and at least one sheet positioned in the accepting space and attached onto a bended part of the plurality of air cylinders. After the plurality of air cylinders are filled with air and expanded, the accepting space can then be used for accepting an article, and the pat or block of the plurality of air cylinders needed to protect is strengthened through the sheet. Whereby, the air cylinders can be prevented form being piecing through and broken by a part of the article such as a projecting face, angle or edge; the production cost can be reduced, more kinds of articles can be accepted in the accepting space and the use convenience can be elevated.

8 Claims, 10 Drawing Sheets

BLOCK STRENGTHENING AIR ENCLOSURE AND MANUFACTURE THEREOF

CROSS-REFERENCES TO RELATED APPLICATIONS

This non-provisional application claims priority under 35 U.S.C. §119(a) on Patent Application No(s). 095149971 filed in Taiwan, R.O.C. on 2006 Dec. 19, the entire contents of which are hereby incorporated by reference.

FIELD OF THE INVENTION

The present invention relates to an air enclosure and a method for manufacturing it, and more particularly to a block strengthening air enclosure and a method for manufacture it.

BACKGROUND

Generally, an article is directly placed into a paper box while being packed. However, the paper box can only be used for packing the article and has no cushioning protection function to cause the article to be damaged easily owing to shake while being transported such that cushioning material is usually placed in the paper box during the packing to elevate the cushioning protection function of the paper box. A general used way is to fill foam between the article and the paper box thereby using the softness of the foam to provide the cushioning protection for the article. However, the price of foam is so high as to cause the packing cost to be increased and thus, it is of no economic interest. Besides, foam is not easy to be processed such that it is harmful to the environment protection. Moreover, although the foam can be tightly attached onto a surface of the article, the collision prevention effect is not good such that the article is still often subjected to collision to cause damage.

Another common cushioning material is Styrofoam. An article is first wrapped by means of Styrofoam, and then placed in a paper box so as to prevent the article from being collided during the transportation. Although Styrofoam can prevent the article from being damaged due to shake, the volume of Styrofoam fluffily occupies a great deal of space and not easy to be decomposed by microorganism as well as will release poison gas to endanger human bodies during an incineration process to cause a serious environmental pollution; Styrofoam is not an ideal cushioning material in nowadays of environmental consciousness upsurge. Moreover, Styrofoam with a fixed size cannot be used for packing all different dimensions and sizes of articles; a different dimension of Styrofoam must be only used for a specific article; this not only is resources wasting but also increases the article packing cost.

For solving the problems mentioned above, an air packing bag made by hot-sealing two sheets of thin plastic film is generated thereby providing a cushioning protection use to an article while being shaken. Although the air packing bag can provide a better cushioning protection, the article is easy to pierce the air packing bag through due to the shake in the air packing bag if the article is provided with sharp angles or hardware joint corners. If a small breach appears on the air packing bag, air in the air packing bag will then be leaked out to cause the air packing bag to loose the cushioning protection effect and further to increase the article packing cost. For solving this problem, the thin plastic film of the air packing bag may be thickened or strengthened so as to avoid being pierced through by the article as far as possible. But, it is impossible to strengthen or thicken only one single face of the air packing bag in a continuous mass production, all faces of the air packing bag must be strengthened or thickened; it leads to a high production cost to loose the market competitiveness.

SUMMARY

For providing an article with a good cushioning protection, preventing the article from being damaged or scratched by collision during the transportation, solving the problem that an air packing bag is easy to be pierced through, and reducing the production cost of a cushioning material, the present invention is proposed. The present invention proposes a block strengthening air enclosure, comprising:

a plurality of air cylinders;

a plurality of nodes, positioned on the plurality of air cylinders to allow the plurality of air cylinders to be bended along the plurality of nodes to form an accepting space for accepting an article; and at least one sheet, positioned in the accepting space and attached onto a bended place of the plurality of air cylinders and used for preventing the article from being pierced through to cause no damage.

The present invention also proposes a method for manufacturing a block strengthening air enclosure. Comprising:

providing at least one inner film;

spreading a heat resistant material intermittently on a part of one face of the inner film;

stacking two outer films to cause the inner film to be lain between the outer films;

hot-sealing the outer films and the inner film, forming at least one air filling passageway and a plurality of air cylinders from the outer films and forming a plurality of air passageways to connect the air filling passage with the plurality of air chambers from the part of the inner film spread with the hear resistant material;

hot-sealing the outer films to form a plurality of nodes on the plurality of air chambers; attaching at least one sheet onto the plurality of nodes of the plurality of air chambers; and bending the plurality of air chambers along the plurality of nodes to form an accepting space to allow the sheet to be positioned in the accepting space;

in which the sheet mentioned above may be glued on the plurality of air chambers, and may also be hot-sealed on the plurality of air chambers.

The sheet mentioned above is a multi-layer compound film or air cushioning sheet. Furthermore, a material of the sheet may be selected from a group constituted by foam, PE foam cloth, PVC, PP, EPE and EPP, or may be selected from a group constituted by corrugated paper, paper and paper-like material such as kraft paper or single-layer corrugated paper box material.

BRIEF DESCRIPTION OF THE DRAWINGS

The present invention can be more fully understood by reference to the following description and accompanying drawings, in which.

DETAILED DESCRIPTION

Figure 1A:
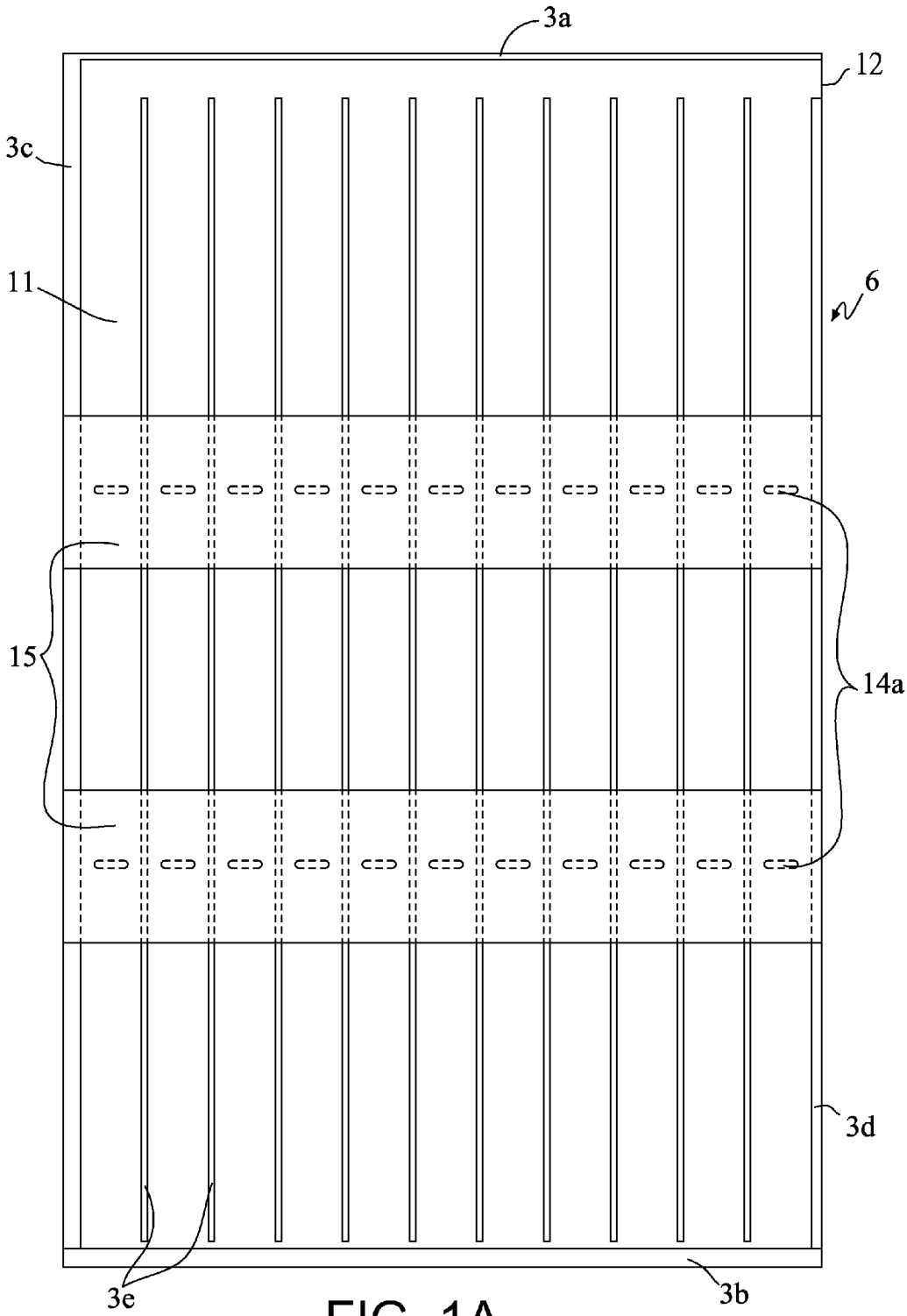
FIG. 1A is a plane view, showing an air enclosure of a first preferred embodiment according to the present invention before being filled with air.
Figure 1B:
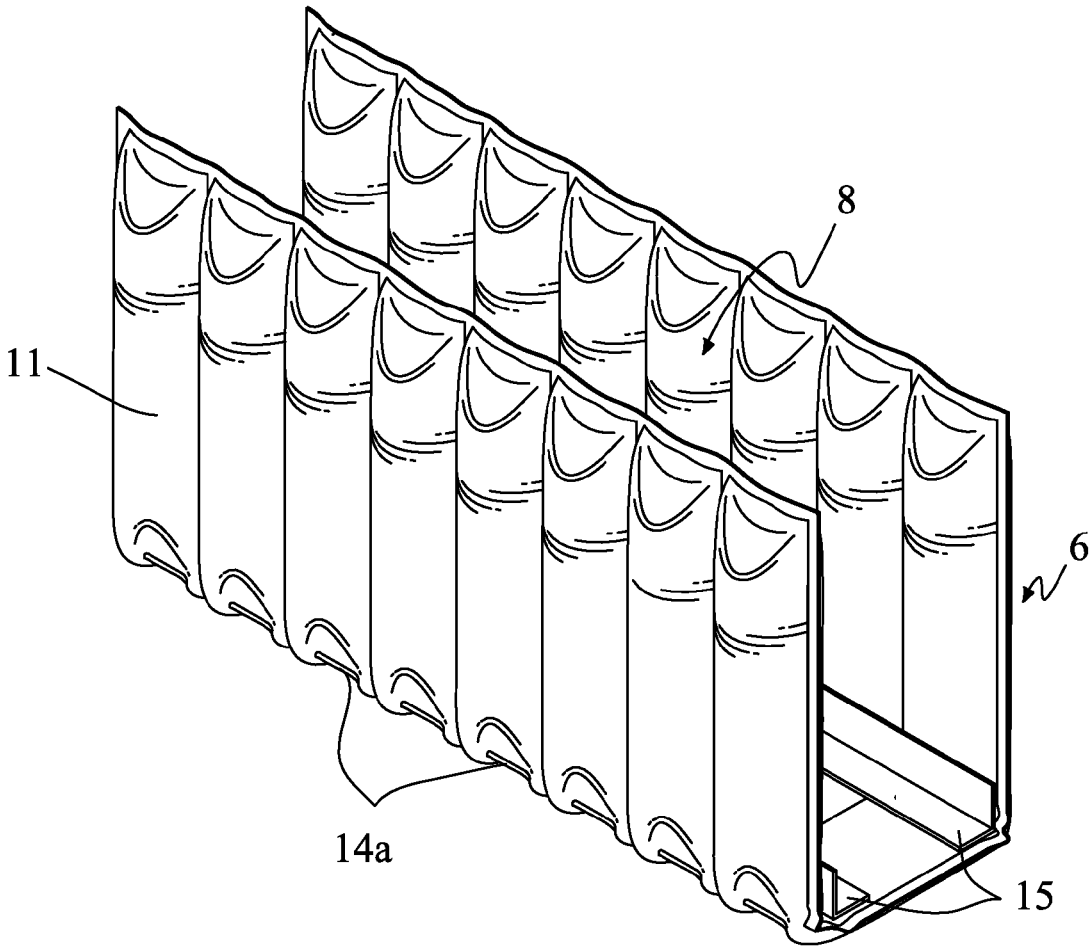
FIG. 1B is a perspective view, showing an air enclosure of the first preferred embodiment according to the present invention after being filled with air.
Figure 1C:
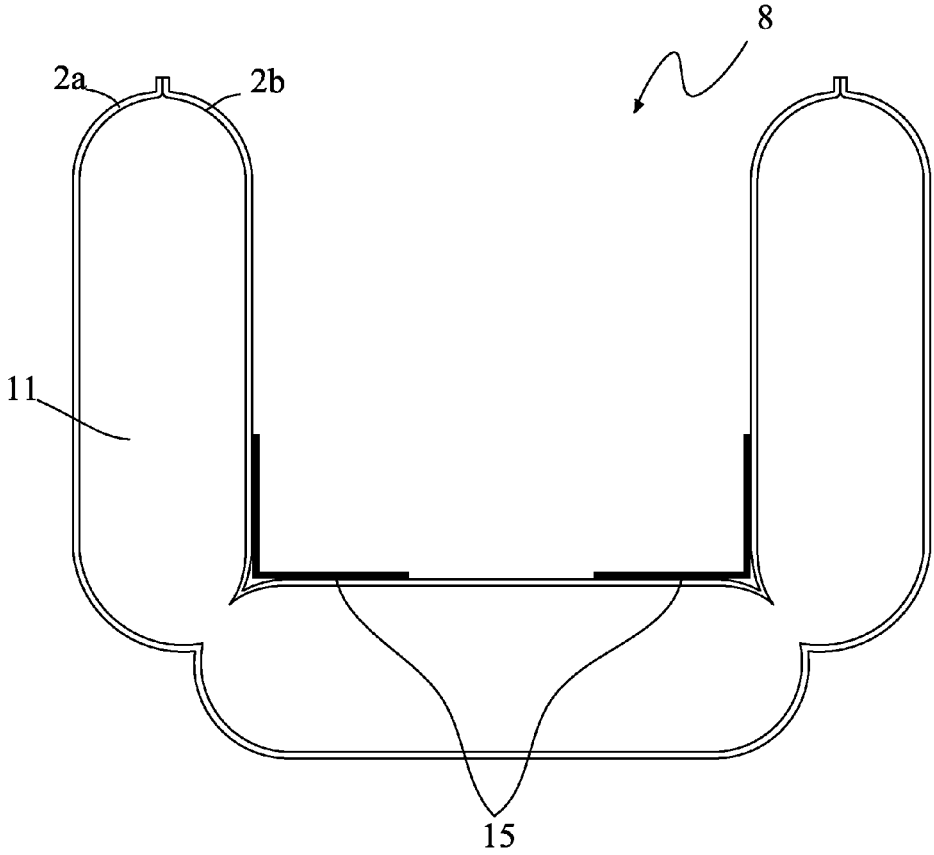
FIG. 1C is a cross sectional view, showing a bended air enclosure of the first preferred embodiment according to the present invention after being filled with air.

Please refer to FIGS. 1A, 1B and 1C. FIG. 1A is a plane view, showing an air enclosure of a first preferred embodiment according to the present invention before being filled with air. FIG. 1B is a perspective view, showing an air enclosure of the first preferred embodiment according to the present invention after being filled with air. FIG. 1C is a cross sectional view, showing a bended air enclosure of the first preferred embodiment according to the present invention after being filled with air.

A block strengthening air enclosure 6 comprises two sheets of outer film 2*a* and 2*b*, and two sheets 15.

The two sheets of outer films 2*a* and 2*b* are stacked vertically.

Hot sealing is carried out along hot sealing lines 3*a*, 3*b*, 3*c* and 3*d* to form a plurality of air cylinders 11, and the two sheets of outer film 2*a* and 2*b* are then adhered to each other by means of hot sealing to form an air filling entrance 12. Next, a plurality nodes 14*a* are generated on the air cylinders 11 by means of hot sealing so as to allow the air cylinders 11 to be bended into a U-typed body along the nodes 14*a*, and an accepting space 8 is formed on the U-typed body.

The sheets 15 are positioned in the accepting space 8 and attached onto bended parts of the plurality of air cylinders 11, and glued on the plurality of air cylinders 11 or adhered onto the plurality of air cylinders 11 by means of hot sealing, and the sheets may also be attached flatly on surfaces of the plurality of air cylinders 11.

The sheet 15 mentioned above may be a multi-layer compound film, and a material of the sheet 15 may be selected from a group constituted by corrugated paper, paper and paper-like material such as bendable or malleable kraft paper or single-layer corrugated paper box material; the material is cut into a proper size sheet and then attached onto positions of the plurality of air cylinders needed to protect or blocks of the plurality of air cylinders.

Air entering the air filling entrance 12 causes the plurality of air cylinders 11 to be filled with air and expanded, the accepting space 8 can then be used to accept an article 20 so as to provide the cushioning protection, and the sheet 15 is used as a strengthened protection layer to parts such as projecting faces, angles or edges of the article 20 to prevent the article 20 from piercing through the air cylinders 11 and the air from being leaked out under a condition that the air filling of the plurality of air cylinders 11 is not influenced. Whereby, not only the packing cost of the article 20 can be reduced, but also the production cost of the air enclosure can be reduced and the problem that the air cylinder is apt to be pierced through by the article 20 can be solved.

Figure 2A:
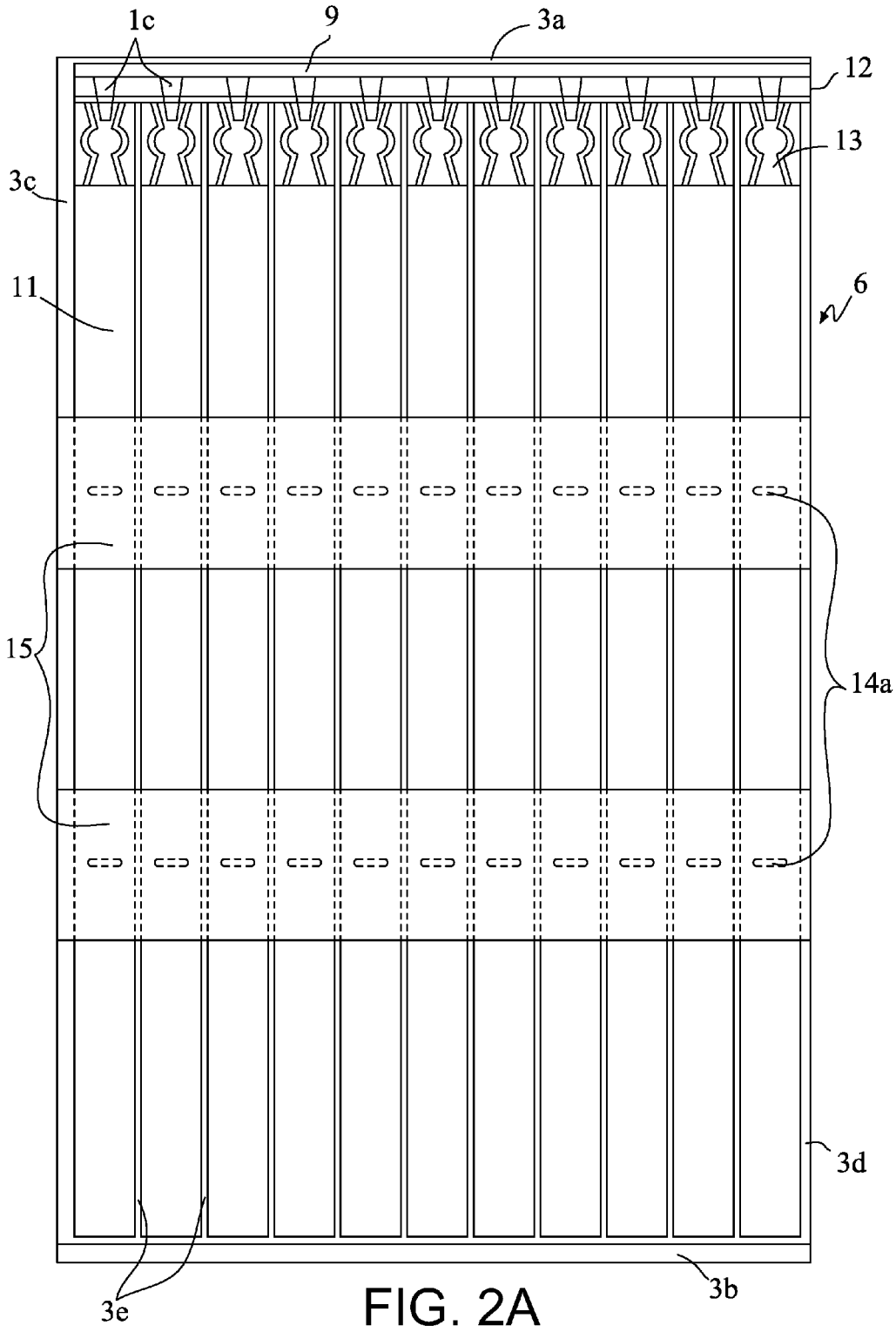
FIG. 2A is a plane view, showing an air enclosure of a second preferred embodiment according to the present invention before being filled with air.
Figure 2B:
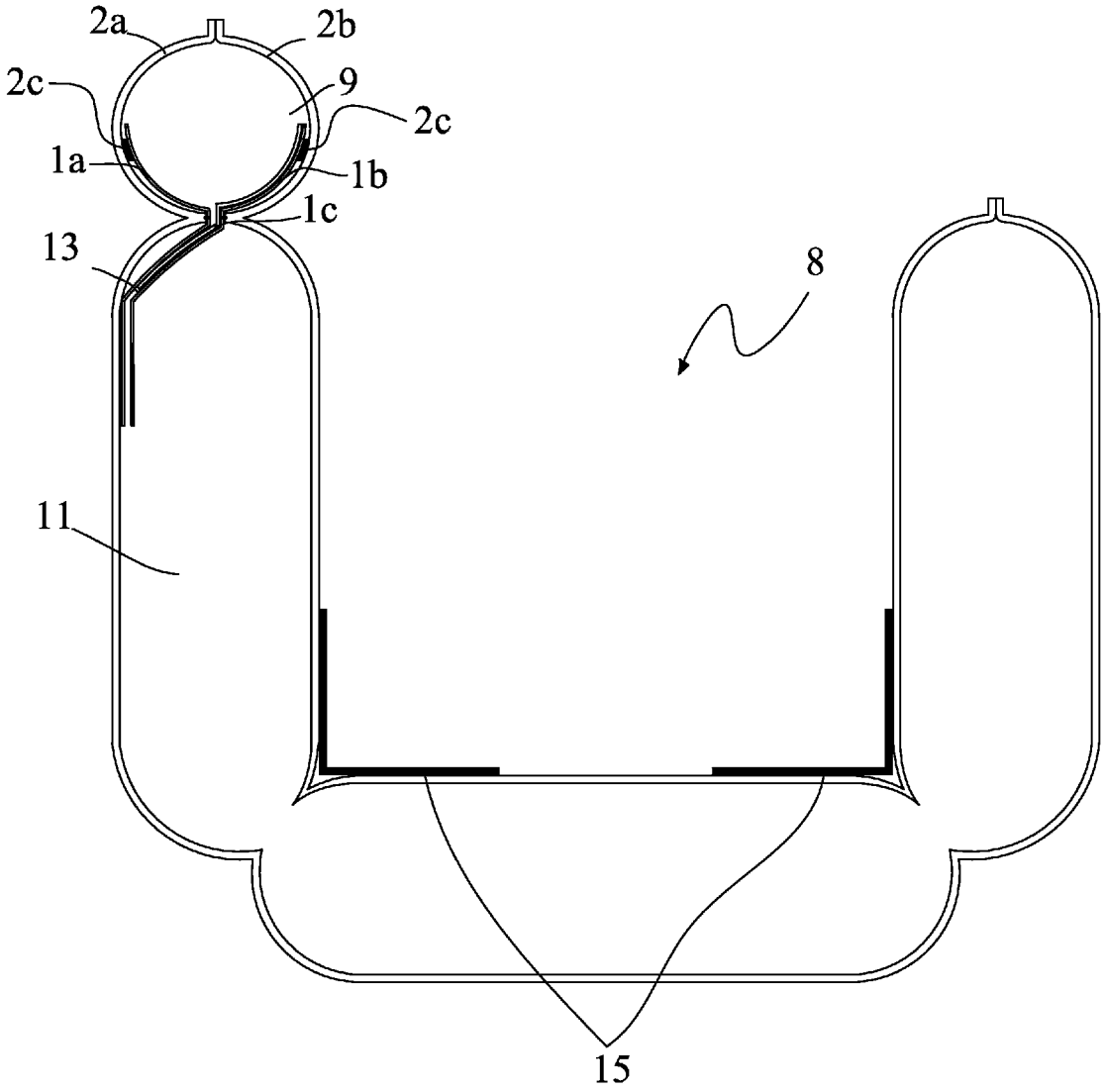
FIG. 2B is a cross sectional view, showing a bended air enclosure of the second preferred embodiment according to the present invention after being filled with air.

Please refer to FIGS. 2A and 2B. FIG. 2A is a plane view, showing an air enclosure of a second preferred embodiment according to the present invention before being filled with air. FIG. 2B is a cross sectional view, showing a bended air enclosure of the second preferred embodiment according to the present invention after being filled with air.

A block strengthening air enclosure 6 comprises two sheets of outer film 2*a* and 2*b*, two sheets of inner film 1*a* and 1*b*, an air filling passageway 9, a plurality of air cylinders 11, a plurality of air passageways 15 and at least one sheet 15.

The two sheets of outer film 2*a* and 2*b* are stacked vertically.

The two sheets of inner films 1*a* and 1*b* are side-attached onto the outer film 2*a* or 2*b*, and a heat resistant material 1*c* is spread between the two sheets of inner film 1*a* and 1*b* so as to use the heat resistant material 1*c* as an air passable passageway thereby forming a continuous check valve or single air filling check valves.

Hot sealing is carried out along hot sealing lines 3*a*, 3*b*, 3*c* and 3*d* to form a plurality of air cylinders 11, in which the two sheets of outer film 2*a* and 2*b* as well as the two sheet of inner film 1*a* and 1*b* are adhered together by means of hot sealing to allow an air filling passageway 9 to be formed between the two sheets of outer film 2*a* and 2*b*; the air filling passageway 9 is passed through the hot sealing line 3*e* and comprises an air filling entrance 12 connected to the outside air. And then, a plurality of nodes 14*a* are generated on the plurality of air cylinders 11 by means of hot sealing to allow the plurality of air cylinders 11 to be bended into a U-typed body along the nodes 14*a*, and an accepting space 8 is formed on the U-typed body.

A heat resistant material 1*c* is spread sequentially and intermittently between the two sheets of inner film 1*a* and 1*b*, for example, by means of heat resistant resin printing or ink printing, the two sheets of inner film 1*a* and 1*b* are still not adhered to each other to form air passageways 13 even by hot sealing.

The sheets 15 are positioned in the accepting space 8 and attached onto bended parts of the air cylinders 11, and glued on the plurality of air cylinders 11 or adhered onto the plurality of air cylinders 11 by means of hot sealing, and the sheets may also be attached flatly on surfaces of the plurality of air cylinders 11.

Air entering the air filling entrance 12 expands the air filling passageway 9 and fills it with air to allow the two sheets of inner film 1*a* and 1*b* to be pulled apart outward to open the air passageways 13 thereby being capable of using the air in the air filling passageway 9 to fill the plurality of air cylinders 11 with air and allow them to be expanded. When the two sheets of inner film 1*a* and 1*b* form a continuous check valve, the air in the air filling passageway 9 can fill the plurality of air cylinders 11 with air simultaneously via the continuous check valve, and when the two sheets of inner film 1*a* and 1*b* form single air filling check valves, the air in the air filling passageway 9 can respectively fill the air cylinders 11 with air. Furthermore, air pressure at a curved part of the air passageway 13 is larger than air pressure at two sides thereof to cause the air in the air filling passageway 9 is easy to enter and not easy to escape out. When the internal pressure of the air cylinder 11 increases, it thrusts the curved part of the air passageway 13 to attain to the air locking effect. Furthermore, when the internal air pressure of the air cylinder 11 compresses the two sheets of inner film 1*a* and 1*b* to attach onto the outer film 2*a* or 2*b* closely, they will cover the air passageway 13 to shield the air cylinder to allow the air not to be leaked out to attain to the air locking effect.

Figure 3:
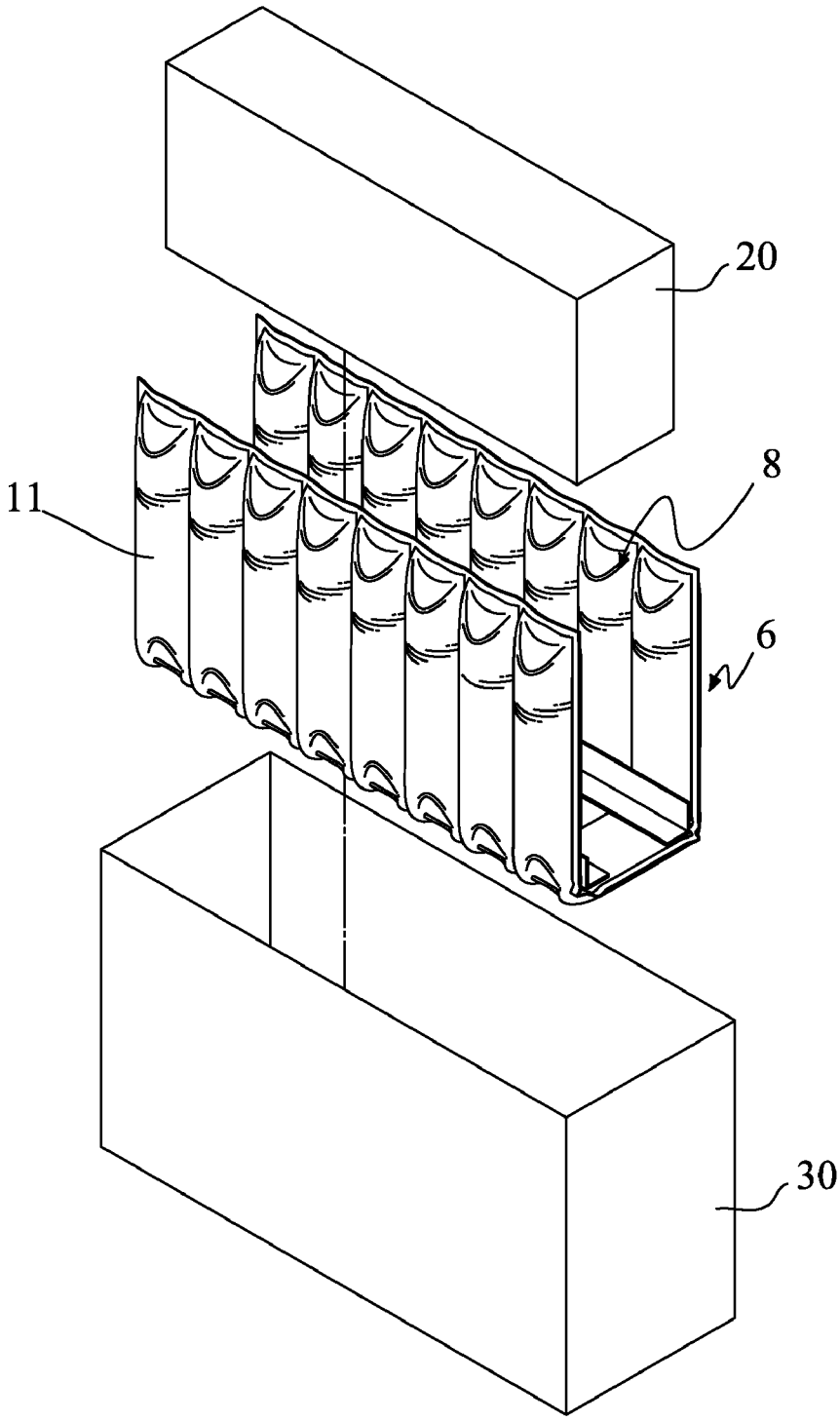
FIG. 3 is a plane view, showing an air enclosure of a third preferred embodiment according to the present invention.

Please refer to FIG. 3. FIG. 3 is a plane view, showing an air enclosure of a third preferred embodiment according to the present invention.

According to a structure disclosed by the present invention, the block strengthening air enclosure 6 further comprises an outer box 30; one face of the plurality of air cylinders 11 not attached with the sheet 15 is attached onto an inner surface of the outer box 30 closely, the accepting space 8 may then be used for accepting an article 20 to provide the cushioning protection and a user is allowed to deliver the article 20 through the outer box 30. In the process of transportation, the sheet 15 is relied on to take as a strengthened protection layer for a part such as projecting face, angle or edge of the article 30 to avoid a situation that the article 20 pierces through the air cylinder 11 to cause the air to be leaked out. Whereby, the packing cost of the article 20 can be reduced, but also the production cost of the air enclosure 6 can be reduced and the problem that the air cylinder 11 is apt to be pierced through by the article 20 can be solved.

In addition, the outermost plurality of air cylinders 11 may also be adhered together by means of hot sealing to allow the air enclosure 6 to form a bag thereby being able to elevate the article accepting convenience.

Figure 4A:
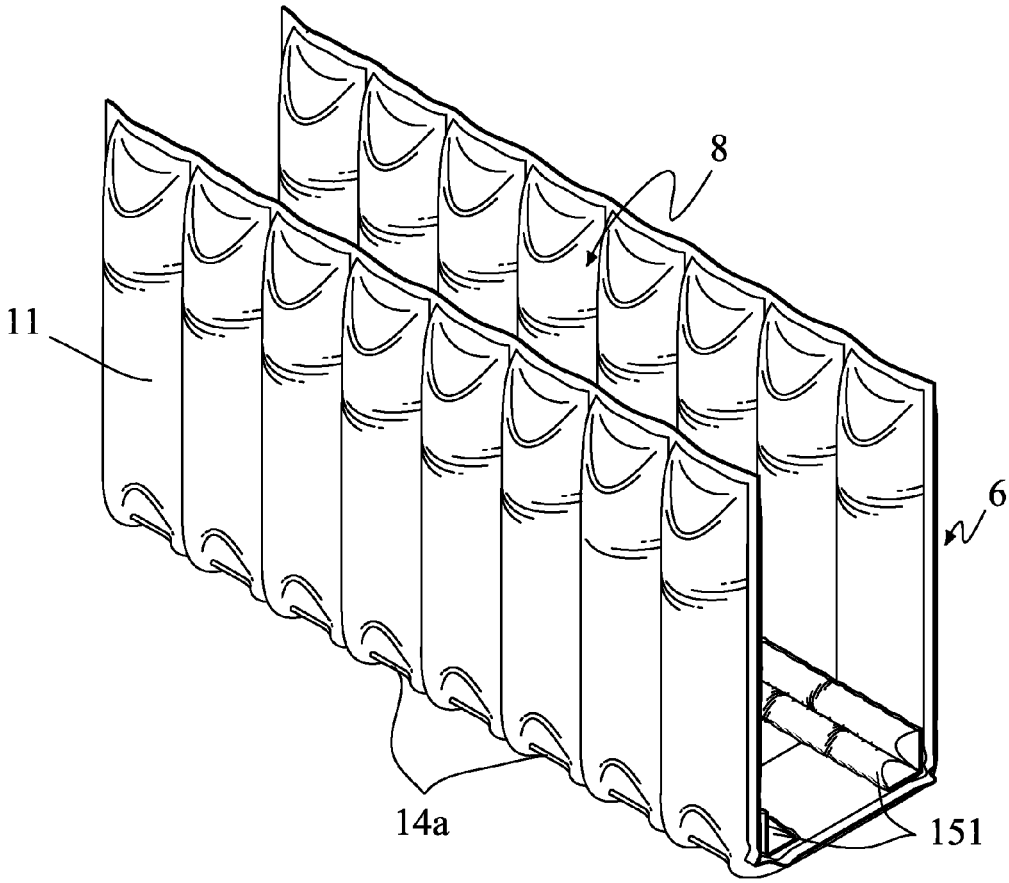
FIG. 4A is a perspective view, showing an air enclosure of a fourth preferred embodiment according to the present invention after being filled with air.
Figure 4B:
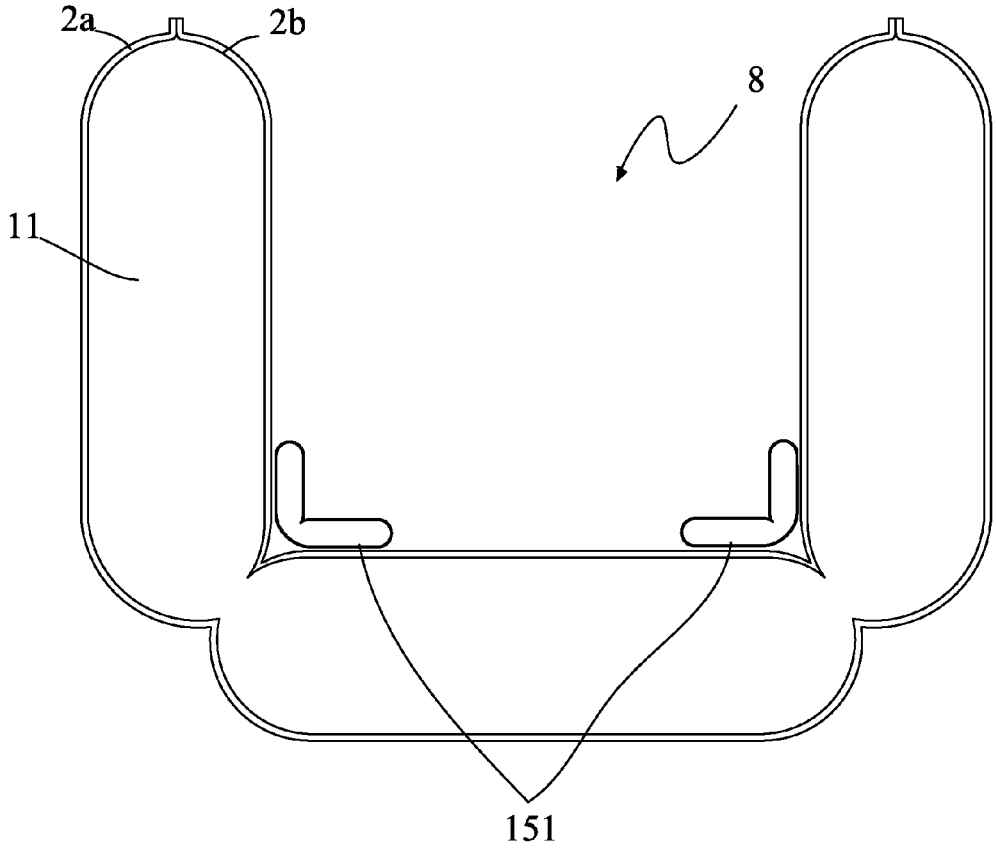
FIG. 4B is a cross sectional view, showing a bended air enclosure of the fourth preferred embodiment according to the present invention after being filled with air.

Please refer to FIGS. 4A and 4B. FIG. 4A is a perspective view, showing an air enclosure of a fourth preferred embodiment according to the present invention after being filled with air. FIG. 4B is a cross sectional view, showing a bended air enclosure of the fourth preferred embodiment according to the present invention after being filled with air.

In this embodiment, the sheet 15 is a foldable or malleable air cushioning sheet 151. The sheet 15 is attached onto a part or block of the plurality of air cylinders 11 needed to protect, and a double air filling is used to allow the plurality of air cylinders 11 and the sheet 15 to be respectively filled with air and expanded so as to form a double cushioning to the part or the block of the plurality of air cylinders 11 needed to protect to elevate the protection for the part or the block of the plurality of air cylinders needed to protect.

Figure 5A:
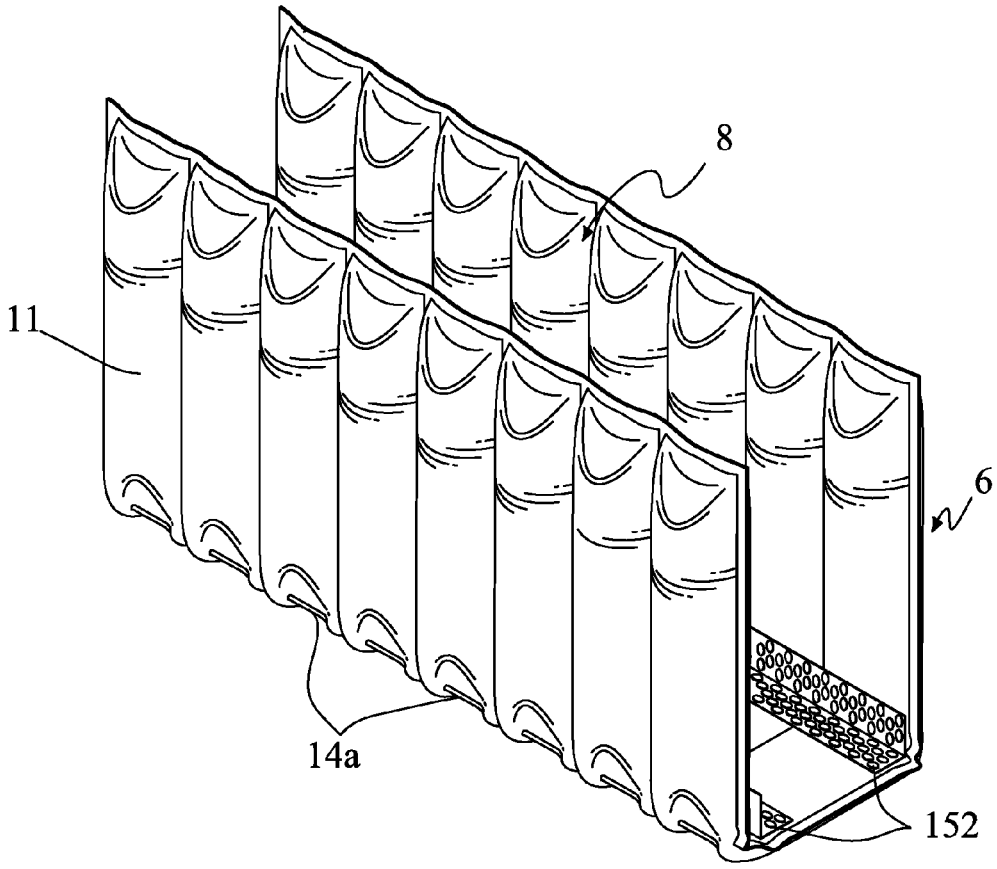
FIG. 5A is a perspective view, showing an air enclosure of a fifth preferred embodiment according to the present invention after being filled with air.
Figure 5B:
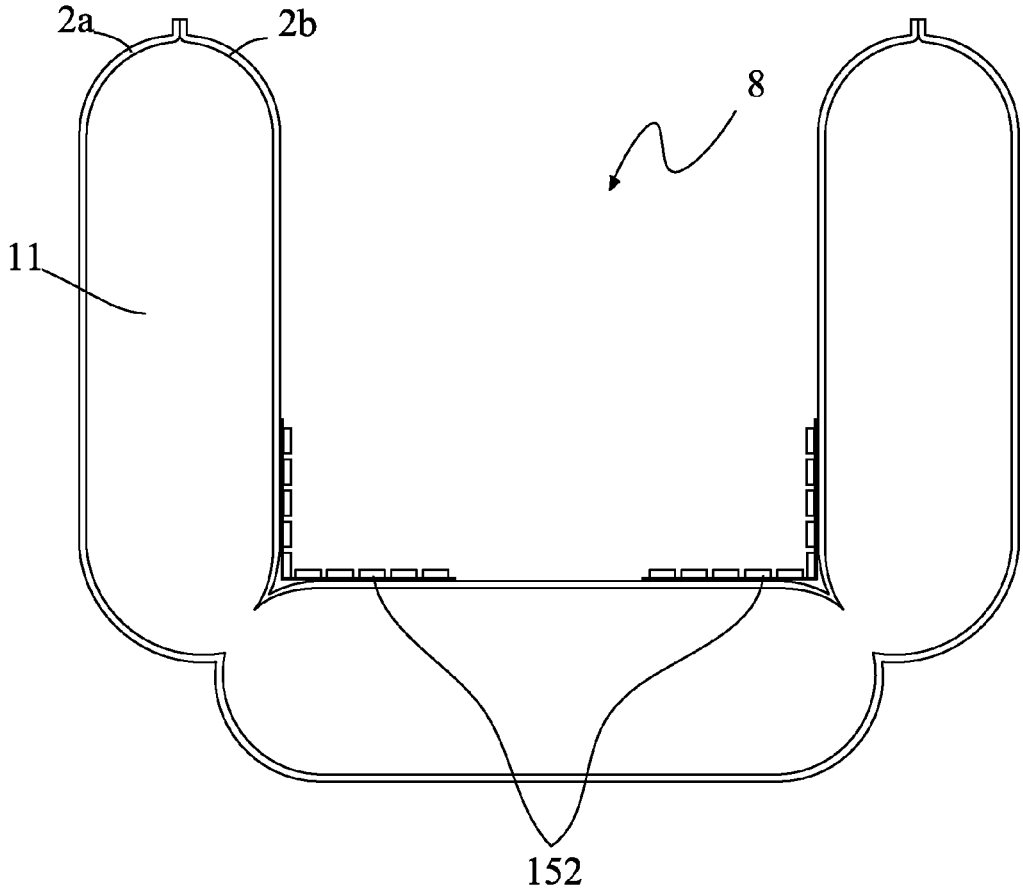
FIG. 5B is a cross sectional view, showing a bended air enclosure of the fifth preferred embodiment according to the present invention after being filled with air.

Please refer to FIGS. 5A and 5B. FIG. 5A is a perspective view, showing an air enclosure of a fifth preferred embodiment according to the present invention after being filled with air. FIG. 5B is a cross sectional view, showing a bended air enclosure of the fifth preferred embodiment according to the present invention after being filled with air.

The sheet 15 may also be a PE foam cloth 152. As a surface of the PE foam cloth 152 is disposed with many small bubble particles, it is attached onto a part or block of the plurality of air cylinders 11 needed to protect by means of hot sealing or gluing in advance after it is cut into a proper size cloth so as to increase the protection effect.

In addition, a material of the sheet 15 may be selected from a group constituted by form, PVC, PP, EPE and FPP.

A method for manufacturing a block strengthening air enclosure 6 comprises the following steps:

Step 1: providing at least one inner film 1*a;*

Step 2: spreading a heat resistant material 1*c* intermittently on a part of one face of the inner film 1*a*, for example, by means of heat resistant resin printing or ink printing;

Step 3: stacking two outer films 2*a* and 2*b* to allow the inner film 1*a* to be lain between the outer films 2*a* and 2*b;*

Step 4: hot-sealing the outer films 2*a* and 2*b* and the inner film 1*a*, forming at least one air filling passageway 9 and a plurality of air cylinders 11 from the outer films 2*a* and 2*b*, and forming a plurality of air passageway 13 to connect the air filling passageway 9 with the plurality of air cylinders 11 from the part of the inner film 1*a* spread with the heat resistant material 1*c;*

Step 5: hot-sealing the outer films 2*a* and 2*b* to form a plurality of nodes 14*a* on the plurality of air cylinders 11;

Step 6: attaching at least one sheet 15 onto a place of the plurality of air cylinders 11 on which the plurality of nodes are disposed.

The sheet 15 may be glued on the plurality of air cylinders 11 or hot-sealed on the plurality of air cylinders 11, and the sheet 15 may also be attached flatly one a surface of the plurality of air cylinders 11.

The sheet mentioned above is a multi-layer compound film or air cushioning sheet. Furthermore, a material of the sheet may be selected from a group constituted by foam, PE foam cloth, PVC, PP, EPE and EPP, or may be selected from a group constituted by corrugated paper, paper and paper-like material; it is attached in advance onto a part or block of the plurality of air cylinders 11 needed to protect by means of hot sealing or gluing after it is cut into a proper size cloth so as to increase the protection effect.

Step 7: bending the plurality of air cylinders 11 along the nodes 14*a* into a U-typed body, and forming an accepting space 8 on the U-typed body to allow the sheets 15 to be positioned in the accepting space 8.

After the air enclosure 6 is manufactured, the plurality of air cylinders 11 are allowed to fill with air and expand through the air in the air filling entrance 12 so as to use the accepting space 8 to accept an article 20 to provide the cushioning protection effect, and the sheet 15 is used as a strengthened protection layer to a part such as projecting face, angle or edge of the article 20 to prevent the article 20 from piercing through the air cylinders 11 and the air from being leaked out under a condition that the air filling of the plurality of air cylinders 11 is not influenced.

In addition, the block strengthening air enclosure 6 further comprises an outer box 30; one face of the plurality of air cylinders 11 not attached with the sheet 15 is attached onto an inner surface of the outer box 30 closely, the accepting space 8 may then be used for accepting an article 20 to provide the cushioning protection and a user is allowed to deliver the article 20 through the outer box 30. In the process of transportation, the sheet 15 is relied on to take as a strengthened protection layer for a part such as projecting face, angle or edge of the article 30 to avoid a situation that the article 20 pierces through the air cylinder 11 to cause the air to be leaked out.

A hot sealing or gluing manner, according to the present invention, is used to attach the sheet 15 manufactured from a piercing-resistant material like a waist belt onto a part or block of the plurality of air cylinders 11 needed to protect As the sheet 15 is attached onto the outside of the air cylinders 11 such that it does not influence the air filling of the plurality of air cylinders 11, and the sheet 15 is used as a strengthened protection layer to a part such as projecting face, angle or edge of the article 20 to avoid a situation that the article 20 pierces through the air cylinders 11 to cause the air to be leaked out so as to extend the life of the air enclosure 6. Whereby, not only the packing cost of the article 20 can be reduced, but also the production cost of the air enclosure can be reduced and the problem that the air cylinder is apt to be pierced through by the article 20 can be solved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A block strengthening air enclosure, comprising:

a plurality of air cylinders, comprising:

two outer films, stacked together vertically;

two inner films, positioned between the two outer films;

an air filling passageway, being a space formed by sticking the two outer films together by means of hot sealing;

a plurality of hot sealing points, positioned in the air filling passageway, where at least one of the plurality of said hot sealing points is positioned between one of the outer films and one of the inner films to stick one of the outer films to one of the inner films and where at least another of the plurality of hot sealing points is positioned between the other of the outer films and the other of the inner films to stick the other of the outer films to the other of the inner films;

a plurality of chambers, disposed at one side of the air filling passageway, being an air storable space formed by sticking the two outer films together by means of hot sealing and used for providing an article with the cushioning protection; and a plurality of air passageways, connected to the air filling passageway and the air chambers, formed by spreading a heat resistant material distantly and sequentially on one face of the inner film and then not stuck to the other film even by means of hot sealing, two sheets of the outer film being pushed apart outward when outside air enters and expands the air filling passageway, the two faces of the inner films being forced apart outward at the hot sealing point to open the air passageway, causing the outside air in the air filling passageway entering the air chambers through the air entering passageways to allow the air chambers to be filled with air and expanded, the outside air entering the air cylinder and then compressing the inner film to cover the air entering passageway to shield the air chamber; and a plurality of nodes, disposed on the plurality air cylinders to allow the plurality of air cylinders to be bended to form an accepting space along the plurality of nodes to use for accepting the article; and at least one sheet, disposed in the accepting space and attached onto a bended place of the plurality of air cylinders, and used for preventing the air cylinders from being pierced through and broken by the article.

2. The block strengthening air enclosure according to claim 1, further comprising an air filling passageway with an air filling entrance to allow outside air to be filled in the air filling passageway via the air filling entrance, and the outside air in the air filling passageway entering the plurality of air cylinders to cause the plurality of air cylinders to be filled with air and expanded.

3. The block strengthening air enclosure according to claim 1, wherein the plurality of air cylinders are bended into a U-typed body along the plurality of nodes.

4. The block strengthening air enclosure according to claim 1, wherein the sheet is glued on the plurality of air cylinders.

5. The block strengthening air enclosure according to claim 1, wherein the sheet is adhered onto the plurality of air cylinders by means of hot sealing.

6. The block strengthening air enclosure according to claim 1, wherein the sheet is a multi-layer compound film.

7. The block strengthening air enclosure according to claim 1, wherein the sheet is an air cushioning sheet.

8. The block strengthening air enclosure according to claim 1, further comprising an outer box, one face of the plurality of air cylinders not attached with the sheet being attached on an inner surface of the outer box closely.

* * * * *